US009945148B1

(12) United States Patent
Schell

(10) Patent No.: US 9,945,148 B1
(45) Date of Patent: Apr. 17, 2018

(54) VEHICLE HITCH SUPPORTED HUT TENT

(71) Applicant: Michael D. Schell, Mukwonago, WI (US)

(72) Inventor: Michael D. Schell, Mukwonago, WI (US)

( * ) Notice: Subject to any disclaimer, the term of this patent is extended or adjusted under 35 U.S.C. 154(b) by 0 days.

(21) Appl. No.: 15/444,378

(22) Filed: Feb. 28, 2017

Related U.S. Application Data

(60) Provisional application No. 62/302,835, filed on Mar. 3, 2016.

(51) Int. Cl.
*E04H 15/06* (2006.01)
*E04H 15/54* (2006.01)

(52) U.S. Cl.
CPC ..... *E04H 15/06* (2013.01); *E04H 15/54* (2013.01)

(58) Field of Classification Search
CPC ..... E04H 15/06; E04H 15/08
See application file for complete search history.

(56) References Cited

U.S. PATENT DOCUMENTS 3,221,756 A * 12/1965 Rupright ..... A47B 37/04 108/50.12
5,660,425 A * 8/1997 Weber ..... E04H 15/06 135/88.01
6,082,269 A * 7/2000 Padberg ..... A47B 37/04 108/44
6,511,088 B2 * 1/2003 Kahlstorf ..... B60D 1/075 224/521
6,722,380 B1 * 4/2004 Hafer ..... B60R 9/06 135/16
7,757,613 B2 * 7/2010 Fisher ..... A47B 37/04 108/44
7,806,131 B1 * 10/2010 Seiler ..... A45B 15/00 135/33.2
7,819,128 B2 * 10/2010 Clark ..... A45B 11/00 135/16
8,123,190 B2 * 2/2012 Kost ..... A45B 11/00 135/88.08
8,485,207 B1 * 7/2013 Boyington ..... E04H 15/06 135/16
8,899,609 B2 * 12/2014 Mayfield ..... B60D 1/48 280/491.1
9,163,426 B1 * 10/2015 Seneker ..... E04H 15/06
9,175,497 B1 * 11/2015 Poudrier ..... B60R 9/06
(Continued)

*Primary Examiner* — David R Dunn
*Assistant Examiner* — Danielle Jackson
(74) *Attorney, Agent, or Firm* — Donald J. Ersler

(57) ABSTRACT

A vehicle hitch support hut tent preferably includes a telescoping hitch tube, a telescoping height tube, a canopy support tube, a plurality of canopy support rods and a canopy sheet. The telescoping hitch tube is retained in a female vehicle hitch. The telescoping height tube preferably includes a base height tube, an adjustment height tube, a support tube receiver and an adjustable support tube. An opposing end of the telescoping hitch tube is secured to the base height tube. An end of the canopy support tube is attached to a top of the adjustment height tube. The canopy support tube preferably includes a base canopy rod and a canopy extension tube. The plurality of canopy support rods extend from the base canopy rod and the canopy extension tube. An opposing end of the plurality of canopy rods are retained in pockets formed on opposing edges of the canopy sheet.

8 Claims, 9 Drawing Sheets

(56) References Cited

U.S. PATENT DOCUMENTS

| | | | | |
|---|---|---|---|---|
| 9,394,718 | B1 * | 7/2016 | Hill | E04H 15/001 |
| 2005/0241546 | A1 * | 11/2005 | Royse | B60R 9/06 108/44 |
| 2006/0254635 | A1 * | 11/2006 | Matheus | E04H 15/06 135/88.05 |
| 2007/0204896 | A1 * | 9/2007 | Gereke-King | A45B 23/00 135/88.08 |
| 2011/0108076 | A1 * | 5/2011 | Connot | E04H 15/06 135/88.05 |
| 2016/0177593 | A1 * | 6/2016 | Richmeier | B60R 11/00 135/88.05 |

* cited by examiner

VEHICLE HITCH SUPPORTED HUT TENT

CROSS-REFERENCES TO RELATED APPLICATIONS

This is a utility patent application taking priority from provisional application No. 62/302,835 filed on Mar. 3, 2016.

BACKGROUND OF THE INVENTION

1. Field of the Invention

The present invention relates tents and more specifically to a vehicle hitch supported hut tent, which is supported by a single upright post extending from the vehicle hitch.

2. Discussion of the Prior Art

There are numerous hitch supported tents in the art. However, it appears the prior art does not disclose a vehicle hitch supported hut tent.

Accordingly, there is a clearly felt need in the art for a vehicle hitch support hut tent, which is supported by a single upright post extending from a vehicle hitch.

SUMMARY OF THE INVENTION

The present invention provides a vehicle hitch support hut tent, which is supported by a single upright post extending from a vehicle hitch. The vehicle hitch support hut tent (hitch tent) preferably includes a telescoping hitch tube, a telescoping height tube, a canopy support tube, a plurality of canopy support rods and a canopy sheet. The telescoping hitch tube includes a hitch insert tube and an adjustment hitch tube. The hitch insert tube includes an outer perimeter, which is sized to be received by an inner perimeter of a female vehicle hitch and an inner perimeter, which is sized to receive an outer perimeter of the adjustment hitch tube. A hitch retainer hole is formed through an end of the hitch insert tube to receive a hitch pin of the female vehicle hitch. A hitch spring pin is preferably formed through a top wall of the hitch insert tube. A threaded shaft of a hand knob is threaded through a side wall of the hitch insert tube. At least one stop strip is preferably secured in an inside perimeter of the hitch insert tube. A plurality of position holes are preferably formed through a top wall of the adjustment tube. The plurality of position holes are sized to receive a location pin of the hitch spring pin.

The telescoping height tube preferably includes a base height tube, an adjustment height tube, a support tube receiver and an adjustable support tube. The base height tube includes a height spring pin formed through a side wall thereof at a top thereof. An inner perimeter of the base height tube is sized to receive an outer perimeter of the adjustable height tube. The adjustment height tube includes a bracket tube, an adjustment tube and a pair of bracket plates. The bracket tube is preferably a square tube and the adjustment tube is preferably a round tube. The bracket tube extends less than a third of the adjustment tube. The pair of bracket plates are attached to opposing sides of the bracket tube with welding or any other suitable method. An inner perimeter of the bracket tube is sized to receive an outer perimeter of the adjustment tube. The bracket tube is secured to the adjustable height tube with welding or any other suitable method. A plurality of height holes are formed through a wall of the adjustment tube to receive a location pin of the height spring pin. The support tube receiver is attached to a side wall of the base height tube with welding or any other suitable process. A support spring pin is formed through a side wall of the support tube receiver at a top thereof. An inside perimeter of the support tube receiver is sized to receive an outer perimeter of the adjustable support tube. A plurality of support holes are formed through the adjustment support tube to receive a location pin of the support spring pin.

The canopy support tube preferably includes a base canopy rod and a canopy extension tube. The base canopy rod includes a canopy bracket tube, a base canopy tube, a plurality of canopy rod receivers and a tube projection. The canopy bracket tube is a square tube. The base canopy tube is a round tube. The canopy bracket tube extends less than a third of a length of the base canopy tube. An inner perimeter of the canopy bracket tube is sized to receive an outside perimeter of the canopy base tube. The canopy bracket tube is retained on one end of the base canopy tube. The plurality of canopy rod receivers extend from opposing sides of the base canopy tube. An included angle between the opposing canopy rods is preferably less than 180 degrees. An inner perimeter of the base canopy tube is sized to firmly receive the tube projection. The tube projection extends from a distal end of the canopy base tube. The canopy extension tube is round and an inner perimeter is sized to slidably receive an outer perimeter of the tube projection. A retention hole is formed through one end of the canopy extension tube and the tube projection to receive a snap button clip or the like to retain the canopy base tube against the canopy extension tube. The plurality of canopy rod receivers extend from substantially opposing sides of the canopy extension tube. The plurality of canopy support rods are retained in the plurality of canopy rod receivers. The canopy sheet includes a plurality of rod pockets located on opposing edges, which are sized to receive distal ends of the plurality of canopy support rods.

Accordingly, it is an object of the present invention to provide a vehicle hitch support hut tent, which is supported by a single upright post extending from a vehicle hitch.

These and additional objects, advantages, features and benefits of the present invention will become apparent from the following specification.

DETAILED DESCRIPTION OF THE PREFERRED EMBODIMENTS

Figure 1:
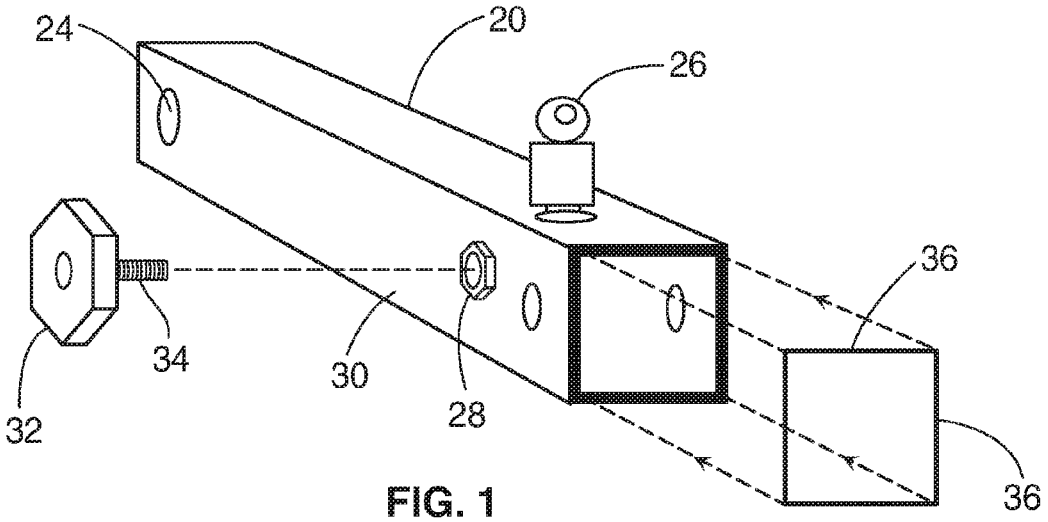
FIG. 1 is a partially exploded perspective view of a hitch insert tube and a four stop strips of a hitch tent in accordance with the present invention.
Figure 2:
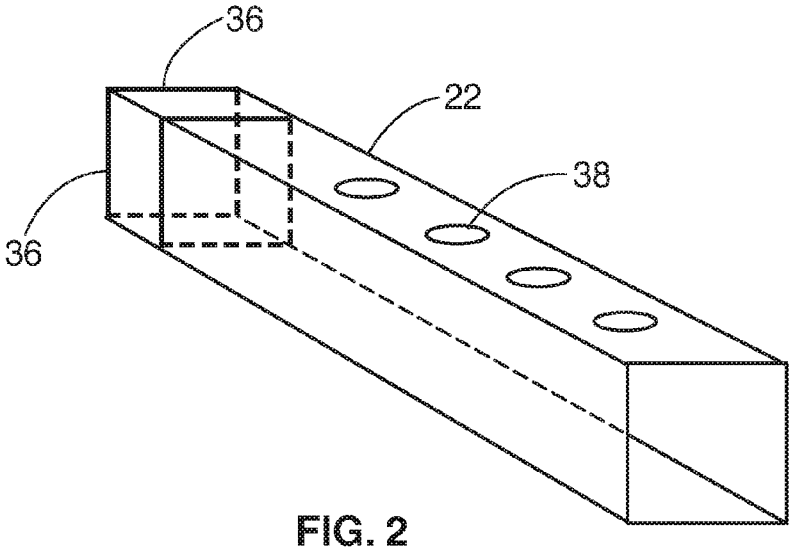
FIG. 2 is a partially exploded perspective view of an adjustment hitch tube of a hitch tent and four stop strips in accordance with the present invention.
Figure 3:
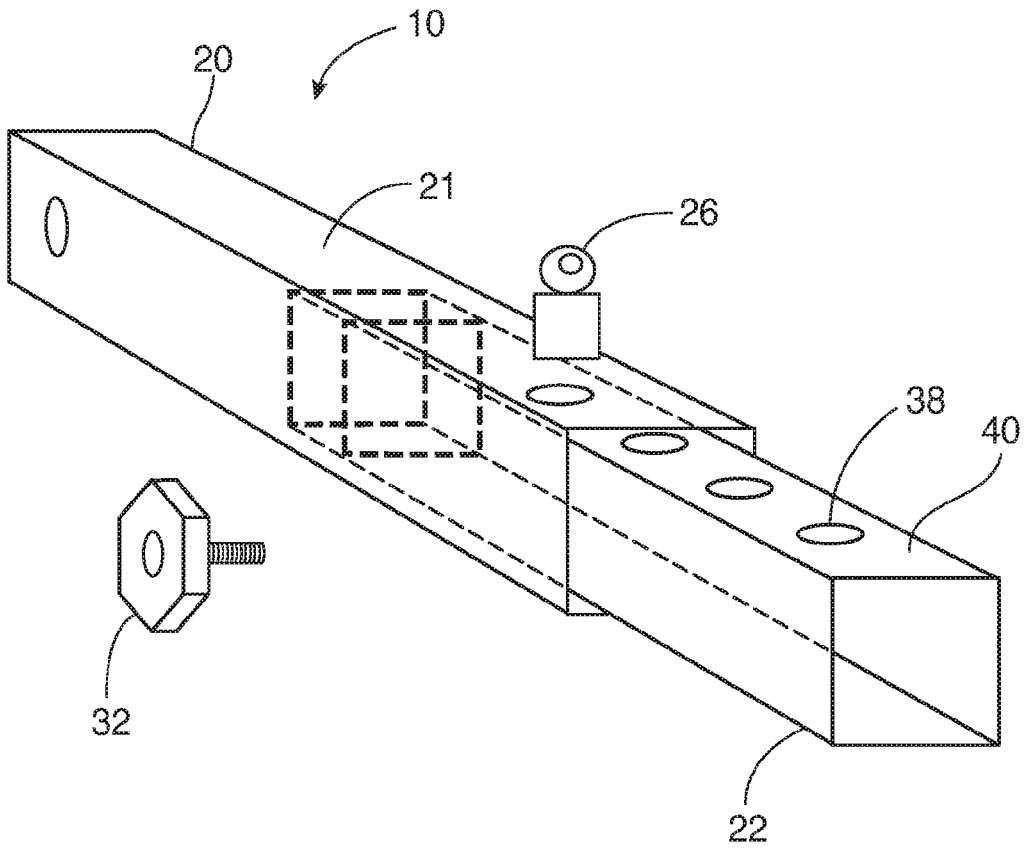
FIG. 3 is perspective view of an adjustment hitch tube retained in a hitch insert tube of a hitch tube in accordance with the present invention.
Figure 4:
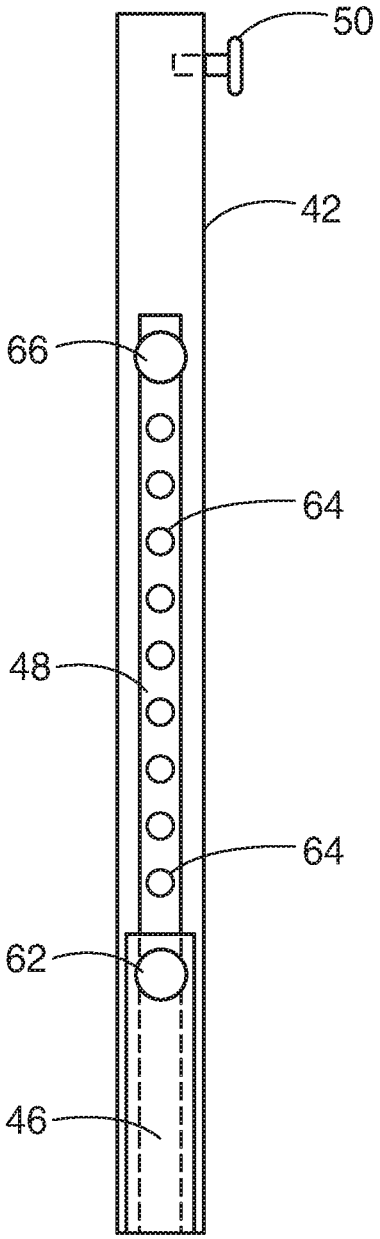
FIG. 4 is a front view of a telescoping height tube without an adjustment height tube of a hitch tent in accordance with the present invention.
Figure 5:
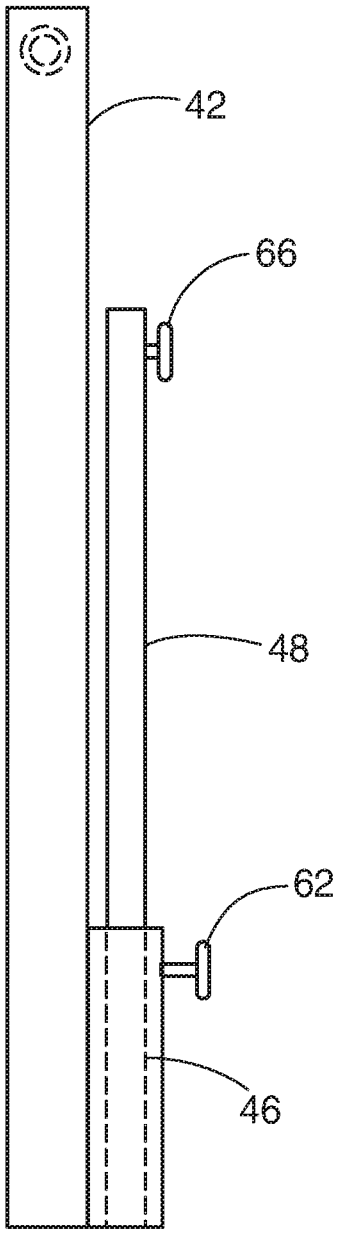
FIG. 5 is a side view of a base height tube of a telescoping height tube without an adjustment height tube of a hitch tent in accordance with the present invention.
Figure 6:
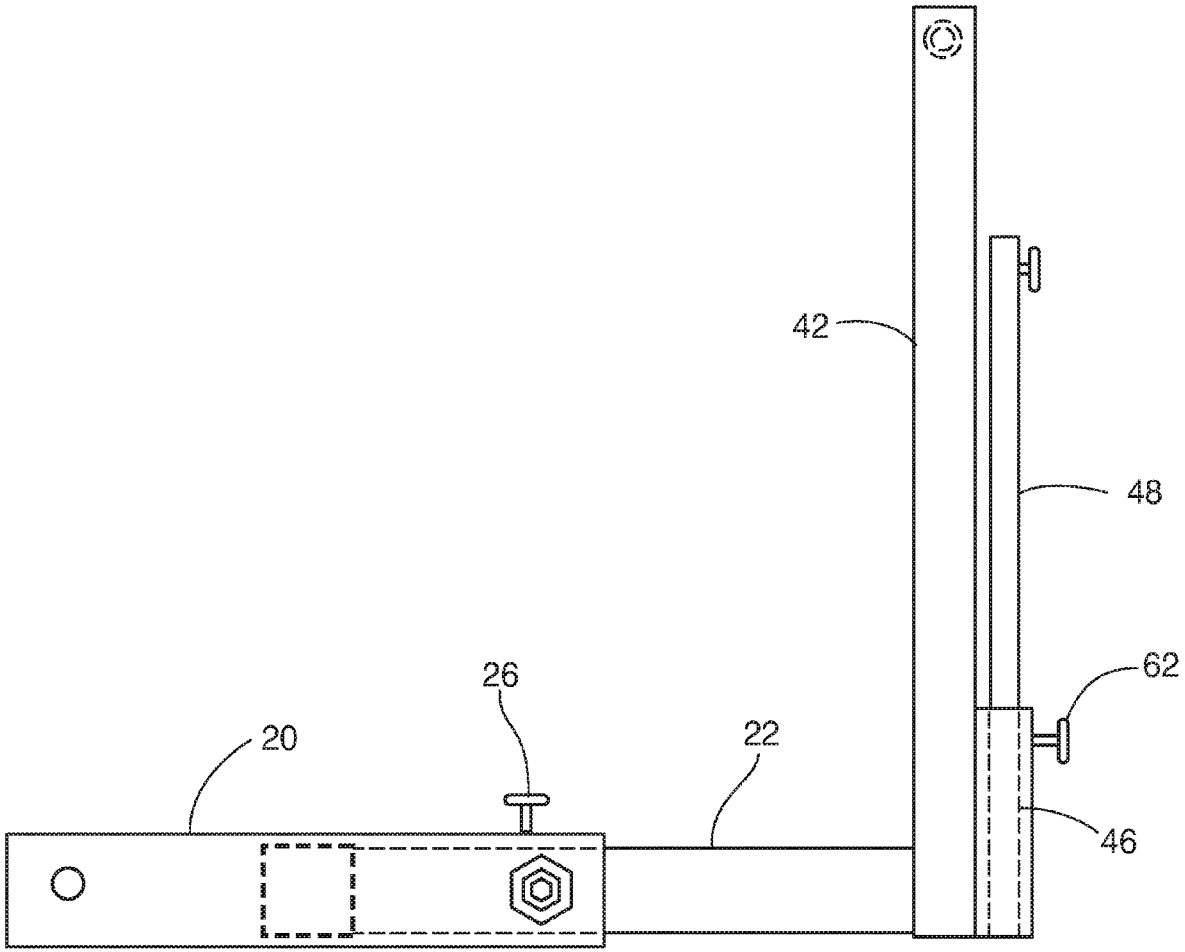
FIG. 6 is a side view of a telescoping hitch tube attached to a telescoping height tube without an adjustment height tube of a hitch tent in accordance with the present invention.
Figure 7:
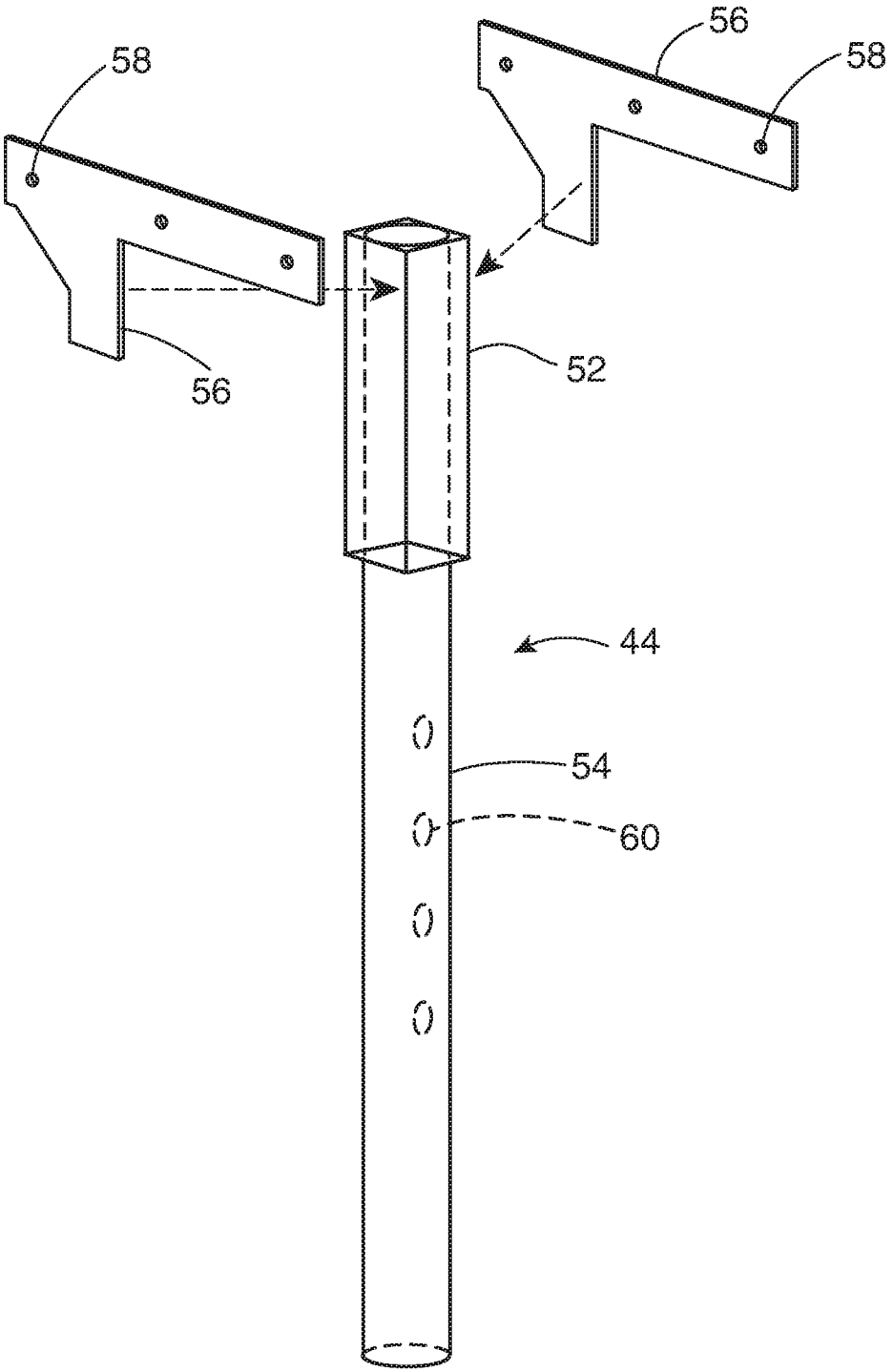
FIG. 7 is a partially exploded perspective view of an adjustment height tube of a hitch tent in accordance with the present invention.
Figure 12:
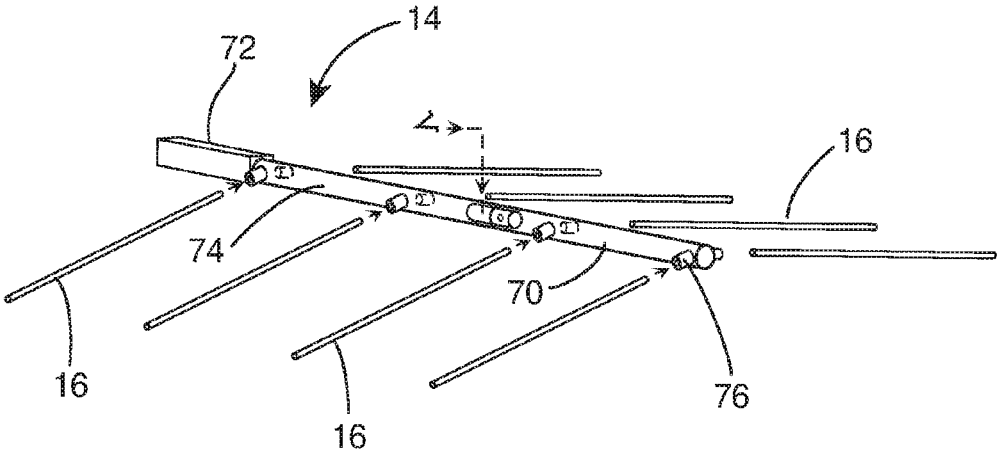
FIG. 12 is a partially exploded perspective view of a canopy support tube with a plurality of canopy support rods of a hitch tent in accordance with the present invention.
Figure 13:
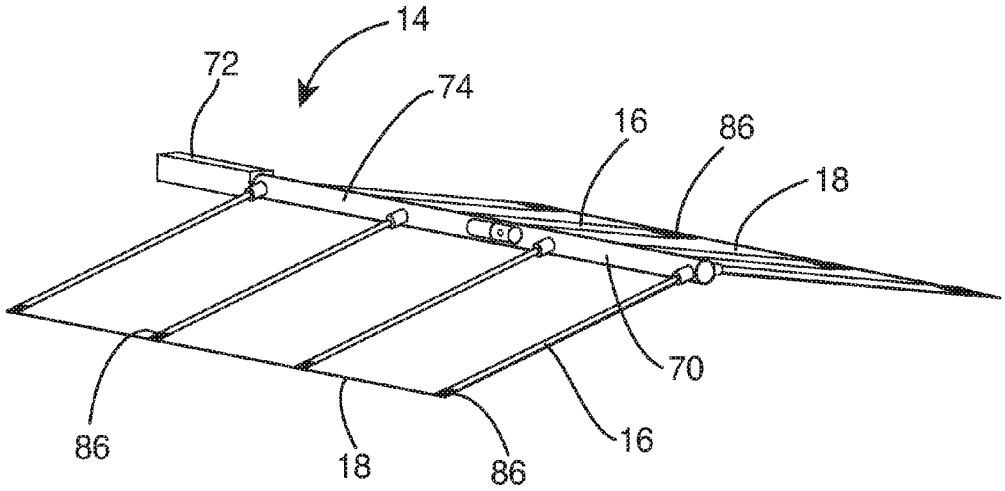
FIG. 13 is a partially exploded perspective view of a canopy support tube, a plurality of canopy support rods and a canopy sheet in accordance with the present invention.
Figure 14:
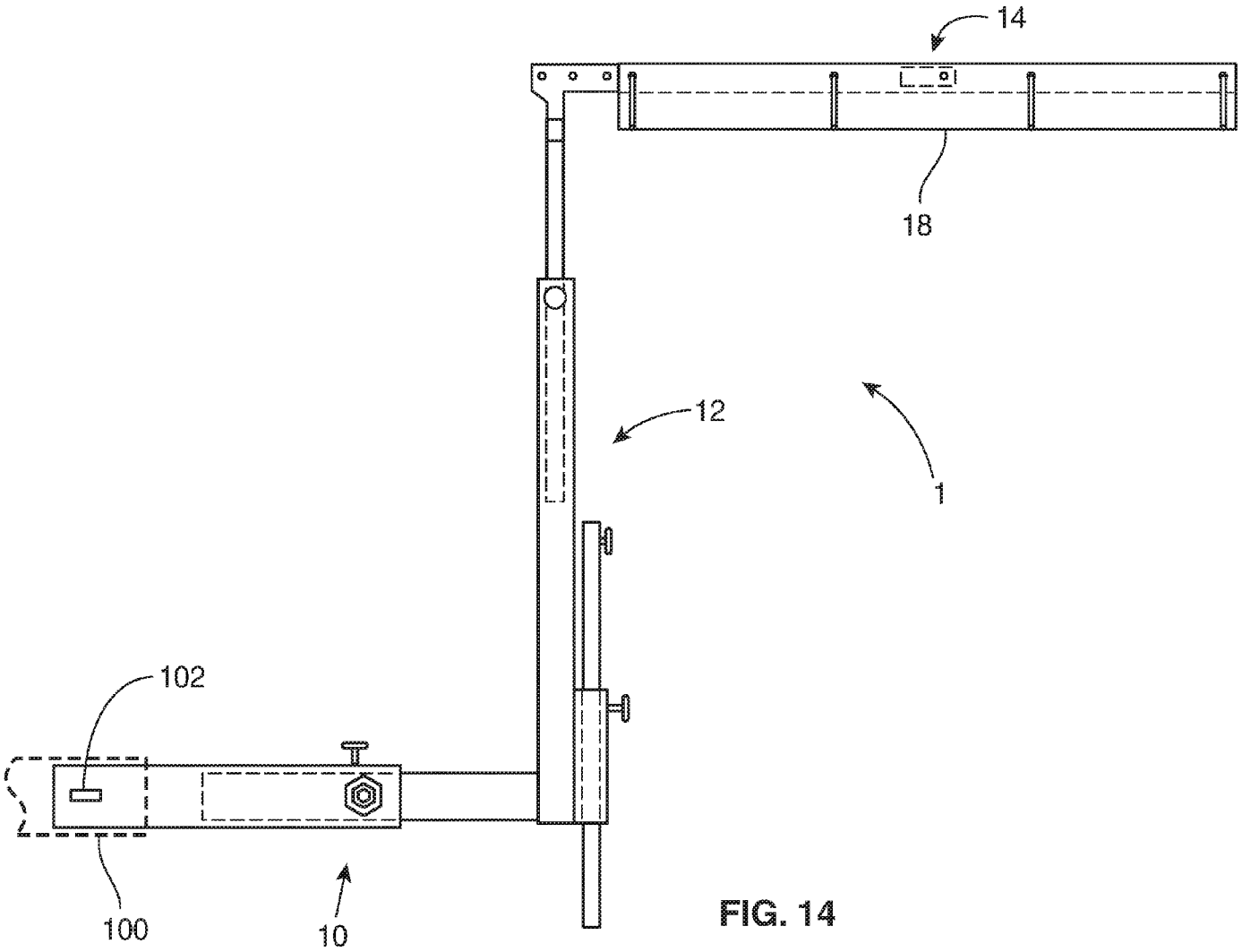
FIG. 14 is a side view of a hitch tent in accordance with the present invention.

With reference now to the drawings, and particularly to FIG. 14, there is shown a side view of a hitch tent 1. With reference to FIG. 12, the hitch tent 1 preferably includes a telescoping hitch tube 10, a telescoping height tube 12, a canopy support tube 14, a plurality of canopy support rods 16 and a canopy sheet 18. With reference to FIGS. 1-3, the telescoping hitch tube 10 includes a hitch insert tube 20 and an adjustment hitch tube 22. With reference to FIG. 14, the hitch insert tube 20 includes an outer perimeter, which is sized to be received by an inner perimeter of a female vehicle hitch 100 and an inner perimeter, which is sized to receive an outer perimeter of the adjustment hitch tube 22. A hitch retainer hole 24 is formed through one end of the hitch insert tube 20 to receive a hitch pin 102 of the female vehicle hitch 100. A hitch spring pin 26 is preferably formed through a top wall 21 of the hitch insert tube 20. A threaded nut 28 is preferably welded to a side wall 30 to threadably receive a threaded shaft 34 of a hand knob 32. Tightening the hand knob 32 forces the adjustment hitch tube 22 against an inner wall of the hitch insert tube 20 to improve rigidity of the hitch tent 1. At least one stop strip 36 is preferably secured in an inside perimeter of the hitch insert tube 20. A plurality of position holes 38 are preferably formed through a top wall 40 of the adjustment tube 22. The plurality of position holes are sized to receive a location pin of the hitch spring pin 26.

With reference to FIGS. 4-7, the telescoping height tube 12 preferably includes a base height tube 42, an adjustment height tube 44, a support tube receiver 46 and an adjustable support tube 48. The base height tube 42 includes a height spring pin 50 formed through a side wall thereof at a top thereof. An inner perimeter of the base height tube 42 is sized to receive an outer perimeter of the adjustable height tube 44. The adjustment height tube 44 includes a bracket tube 52, an adjustment tube 54 and a pair of bracket plates 56. The bracket tube 52 is preferably a square tube and the adjustment tube 54 is preferably a round tube. The bracket tube 52 preferably extends less than a third of the adjustment tube 54. The pair of bracket plates 56 are attached to opposing sides of the bracket tube 52 with welding or any other suitable method. An inner perimeter of the bracket tube 52 is sized to receive an outer perimeter of the adjustment tube 54. The adjustment tube 54 is secured to the bracket tube 52 with welding or any other suitable method at one end of the adjustment tube 54.

A plurality of canopy holes 58 are formed through the pair of bracket plates 56. To receive a plurality of fasteners for removably securing the adjustment height tube 44 to the canopy support tube 14. A plurality of height holes 60 are formed through a wall of the adjustment tube 54 to receive a location pin of the height spring pin 50. The support tube receiver 46 is attached to a side wall of the base height tube 42 with welding or any other suitable process. A support spring pin 62 is formed through a side wall of the support tube receiver 46 at a top thereof. An inside perimeter of the support tube receiver 46 is sized to receive an outer perimeter of the adjustable support tube 48. The support tube receiver 46 is preferably a square tube and the adjustable support tube 48 is preferably a round tube. A plurality of support holes 64 are formed through the adjustment support tube 48 to receive a location pin of the support spring pin 62. A support hand knob 66 is preferably threaded through a side wall of the adjustable support tube 48.

Figure 8:
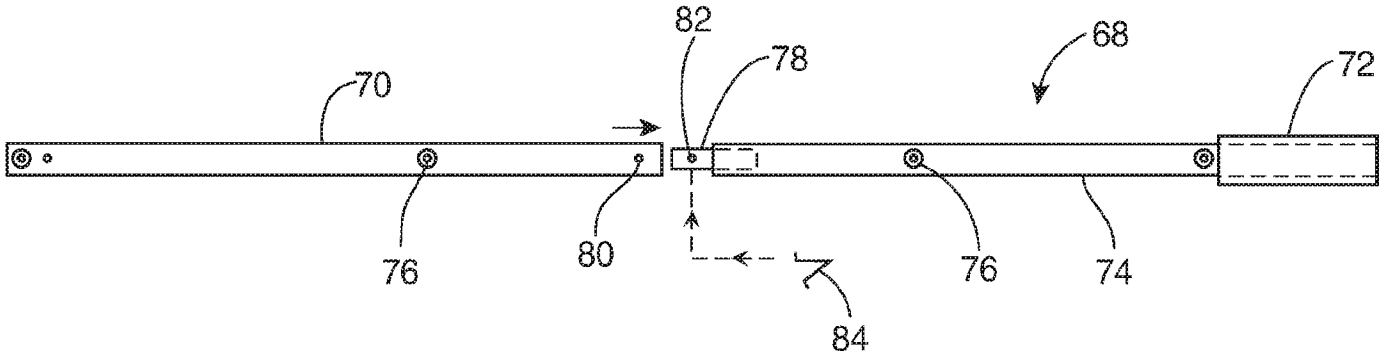
FIG. 8 is a partially exploded side view of a canopy support tube of a hitch tent in accordance with the present invention.
Figure 9:
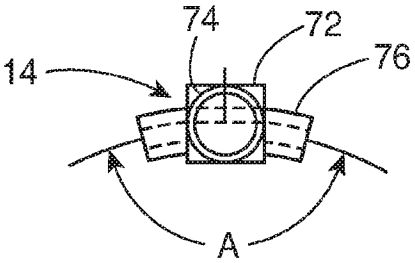
FIG. 9 is an enlarged end view of a canopy support tube of a hitch tent in accordance with the present invention.
Figure 10:
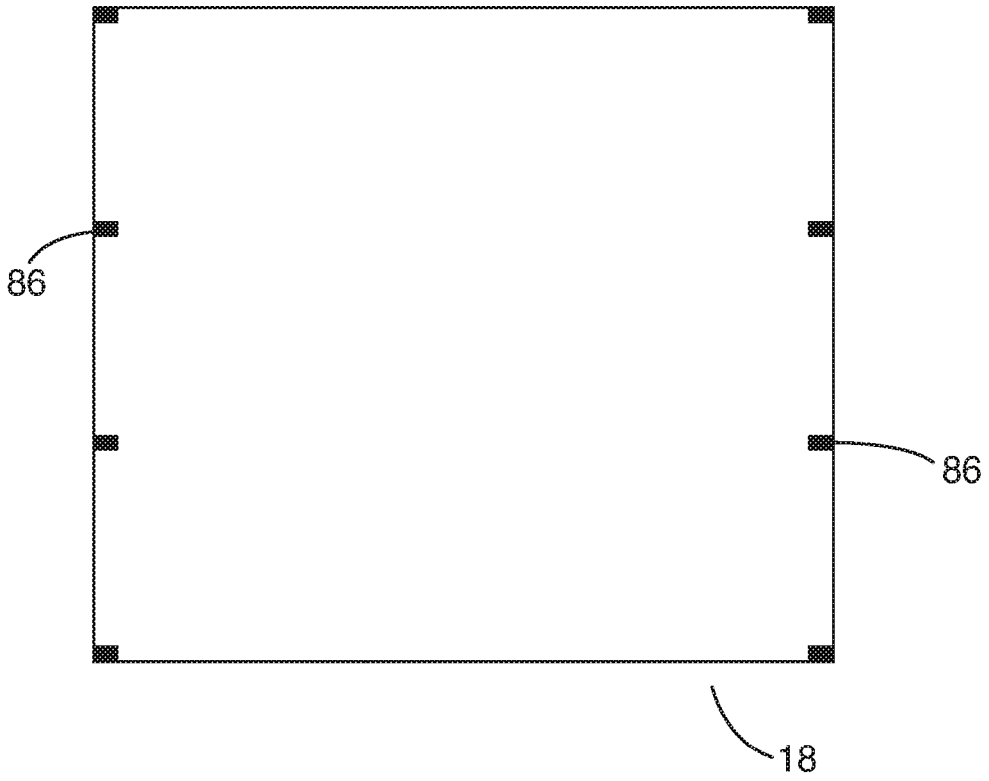
FIG. 10 is a top view of a canopy sheet of a hitch tent in accordance with the present invention.
Figure 11:
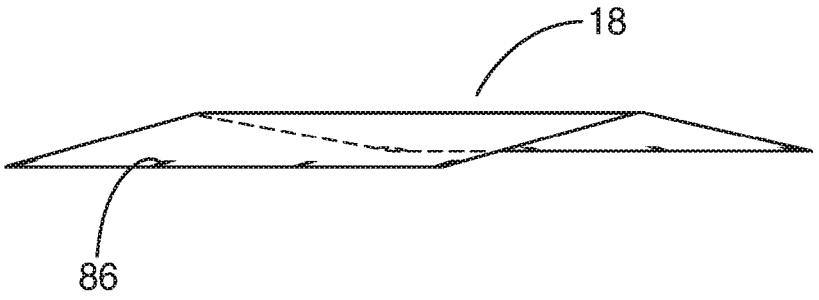
FIG. 11 is a perspective view of a canopy sheet of a hitch tent in accordance with the present invention.

With reference to FIG. 8, the canopy support tube 14 preferably includes a base canopy rod 68 and a canopy extension tube 70. The base canopy rod 68 includes a canopy bracket tube 72, a base canopy tube 74, a plurality of canopy rod receivers 76 and a tube projection 78. The canopy bracket tube 72 is preferably a square tube and the base canopy tube 74 is preferably a round tube. The canopy bracket tube 72 preferably extends less than a third of a length of the base canopy tube 74. An inner perimeter of the canopy bracket 72 is sized to receive an outside perimeter of one end of the canopy base tube 74. The canopy bracket tube 72 is retained on one end of the base canopy tube 74. With reference to FIG. 9, the plurality of canopy rod receivers 76 extend from opposing sides of the base canopy tube 74 and the canopy extension tube 70. With reference to FIG. 11, an included angle "A" between the opposing canopy rods is preferably less than 180 degrees to provide the canopy sheet 18 with a ridge. An inner perimeter of the base canopy tube 74 is sized to firmly receive the tube projection 78. The tube projection 78 extends from an opposing end of the canopy base tube 74. The canopy extension tube 70 is round and an inner perimeter is sized to slidably receive an outer perimeter of the tube projection 78. A tube retention hole 80 is formed through one end of the canopy extension tube 70 and a projection retention hole 82 is formed the tube projection 78 to receive a snap button clip 84 or the like to retain the canopy base tube 74 against the canopy extension tube 70. With reference to FIGS. 10-13, one end of the plurality of canopy support rods 16 are retained in the plurality of canopy rod receivers 76. The canopy sheet 18 includes a plurality of rod pockets 86 located on opposing edges, which are sized to receive opposing ends of the plurality of canopy support rods 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vehicle hitch supported hut tent consisting of:

a hitch tube having one end retained in a female hitch receiver;

a single telescoping height tube includes a base height tube and an adjustment height tube, an opposing end of said hitch tube is attached to a bottom of said base height tube, said adjustment height tube is slidably retained in said base height tube, an axis of said base height tube and said adjustment height tube have a vertical orientation;

a canopy support tube having one end secured to a top of said adjustable height tube;

a plurality of canopy support rods extend outward in substantially opposing directions from said canopy support tube;

a canopy sheet is secured to said plurality of canopy support rods; and a support tube receiver is attached to a side wall of said base height tube, an adjustable support tube is slidably retained in said support tube receiver, said support tube receiver has an axis that is parallel to said axis of said telescoping height tube.

2. The vehicle hitch supported hut tent of claim 1 wherein:

said canopy support tube includes a base canopy rod and a canopy extension tube, said canopy extension tube is removably attachable to an end of said base canopy tube.

3. The vehicle hitch supported hut tent of claim 2 wherein:

a plurality of canopy rod receivers extend from substantially opposing sides of said base canopy rod and said canopy extension tube, said plurality of canopy rod receivers are sized to receive one end of said plurality of canopy support rods.

4. The vehicle hitch supported hut tent of claim 1 wherein:

said canopy sheet includes a plurality of rod pockets formed on opposing edges thereof, said plurality of rod pockets are sized to receive opposing ends of said plurality of canopy support rods.

5. A vehicle hitch supported hut tent consisting of:

a hitch tube having one end retained in a female hitch receiver, said hitch tube includes a hitch insert tube and an adjustment hitch tube, said adjustment hitch tube is slidably retained in said hitch insert tube;

a single telescoping height tube includes a base height tube and an adjustment height tube, an opposing end of said hitch tube is attached to a bottom of said base height tube, said adjustment height tube is slidably retained in said base height tube, an axis of said base height tube and said adjustment height tube have a vertical orientation;

a canopy support tube having one end secured to a top of said adjustable height tube;

a first plurality of canopy rods extend from a first side of said canopy support tube, a second plurality of canopy rods extend from an opposing second side of said canopy support tube, an axis of said first plurality of canopy rods are parallel to each other, said second plurality of canopy rods are parallel to each other; and a canopy sheet is secured to said canopy support tube and said first and second plurality of canopy rods, said canopy sheet includes a plurality of rod pockets formed on opposing edges thereof, said plurality of rod pockets are sized to receive opposing ends of said first and second plurality of canopy support rods, an axis of said plurality of canopy rod pockets are parallel to each other.

6. The vehicle hitch supported hut tent of claim 5, further comprising:

a support tube receiver is attached to a side wall of said base height tube, an adjustable support tube is slidably retained in said support tube receiver.

7. A vehicle hitch supported hut tent consisting of:

a hitch tube having one end retained in a female hitch receiver, said hitch tube includes a hitch insert tube and an adjustment hitch tube, said adjustment hitch tube is slidably retained in said hitch insert tube;

a single telescoping height tube includes a base height tube and an adjustment height tube, an opposing end of said hitch tube is attached to a bottom of said base height tube, said adjustment height tube is slidably retained in said base height tube, an axis of said base height tube and said adjustment height tube have a vertical orientation a canopy support tube having one end secured to a top of said adjustable height tube;

at least three first canopy rods extend from a first side of said canopy support tube, at least three second canopy rods extend from an opposing second side of said canopy support tube, an axis of said at least three first canopy rods are parallel to each other, said at least three second canopy rods are parallel to each other; and a canopy sheet is secured to said canopy support tube and said at least three first and second canopy rods, said canopy sheet includes a plurality of rod pockets formed on opposing edges thereof, said plurality of rod pockets are sized to receive opposing ends of said at least three first and second canopy support rods, said opposing ends of said at least three first and second canopy support rods are removably insertable into said plurality of rod pockets, an axis of said plurality of canopy rod pockets are parallel to each other.

8. The vehicle hitch supported hut tent of claim 7, further comprising:

a support tube receiver is attached to a side wall of said base height tube, an adjustable support tube is slidably retained in said support tube receiver.

* * * * *